United States Patent [19]

Zurit et al.

[11] 4,180,189

[45] Dec. 25, 1979

[54] SINGLE VALVE DISPENSING TUBE

[75] Inventors: David Zurit, Tenafly, N.J.; Vincent Cerrato, Pomona; James Hines, Port Jervis, both of N.Y.

[73] Assignee: Vending Components, Inc., Hackensack, N.J.

[21] Appl. No.: 868,492

[22] Filed: Jan. 11, 1978

[51] Int. Cl.[2] ..... B65D 83/00; B67D 1/04

[52] U.S. Cl. ..... 222/400.7; 137/212

[58] Field of Search ..... 222/400.7, 400.8; 137/212

[56] References Cited

U.S. PATENT DOCUMENTS

| | | | |
|---|---|---|---|
| 3,672,390 | 6/1972 | Gravesteijn | 222/400.7 X |
| 3,908,861 | 9/1975 | Johnston | 222/400.7 X |

FOREIGN PATENT DOCUMENTS

| | | | |
|---|---|---|---|
| 709248 | 5/1965 | Canada | 222/400.7 |
| 709717 | 5/1965 | Canada | 222/400.7 |
| 2639918 | 3/1978 | Fed. Rep. of Germany | 222/400.7 |
| 1256427 | 12/1971 | United Kingdom | 137/212 |

*Primary Examiner*—David A. Scherbel

*Attorney, Agent, or Firm*—Roy C. Hopgood; John M. Calimafde; Charles W. Neill

[57] ABSTRACT

This beer-dispensing apparatus has a keg fitting with a single valve in the keg that is operated by an annular probe in a probe fitting to control the flow of the beer from the keg and the flow of gas into the keg. Both gas flow and beer flow are shut off automatically when the probe moves upward in the probe fitting. A conventional bayonet connection is used to connect the probe fitting to the keg; but a single handle, operated sequentially, connects the probe fitting to the keg and then opens the keg valve by further movement of the handle in the same direction.

12 Claims, 5 Drawing Figures

FIG. 2.
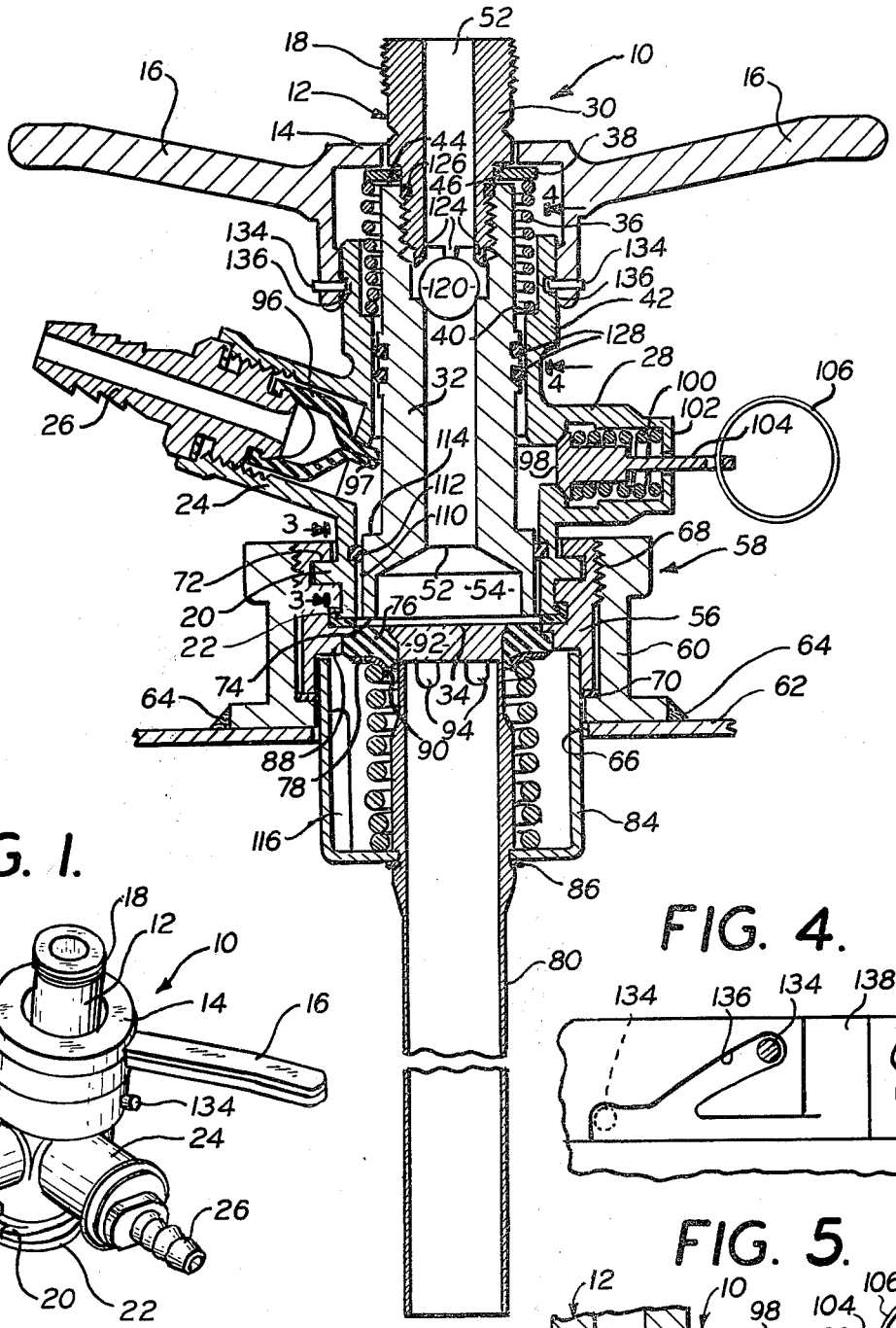
FIG. 1.
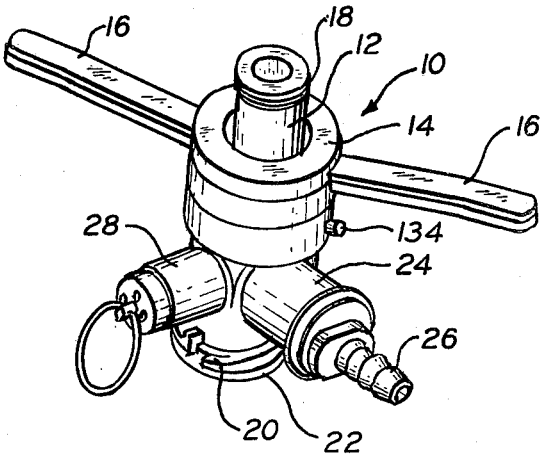
FIG. 4.
FIG. 5.
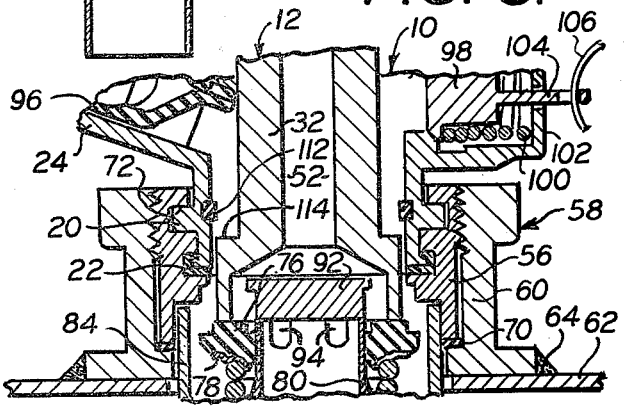
FIG. 3.
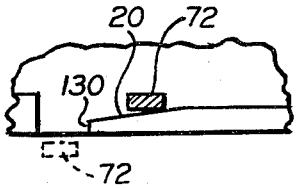

SINGLE VALVE DISPENSING TUBE

BACKGROUND AND SUMMARY OF THE INVENTION

This invention has a single annular valve at the upper end portion of a down tube in a beer keg with provision for the flow of beer from the keg across the inner circumference of the annular valve element, and the flow of gas into the keg across the outer circumference of the annular valve element. A probe with an annular end face contacts with the top surface of the valve element to provide a passage for the beer that flows from the down tube and across the inside circumference of the valve element; and the probe has a clearance around its outside surface providing a passage for gas to flow into the keg around the outside circumference of the annular valve element.

The annular valve element is intended primarily for use with a down tube that is in fixed position in the keg with the upper end of the down tube closed and with ports around the circumference of the down tube just below the upper end of the tube. The valve element slides on the down tube from a position where it covers the ports to a lower position in which the upper surface of the valve element is below the upper ends of the ports so that beer flows through the ports and into the passage provided by the tubular probe in contact with the top surface of the valve element.

The probe is movable up and down in a probe fitting and is urged upward by a spring. A handle of the probe fitting operates cam mechanism that overcomes the pressure of the spring and moves the probe downward to open the valve in the keg fitting. The probe fitting is connected with the keg fitting by a conventional bayonet type connection; and it is a feature of this invention that the handle on the probe fitting turns the probe fitting in the direction required to lock the bayonet connection and secure the probe fitting during the first part of the movement of the handle; and further movement of the handle in the same direction moves the probe downward to open the valve in the keg.

Other objects, features and advantages of the invention will appear or be pointed out as the description proceeds.

BRIEF DESCRIPTION OF DRAWING

In the drawing, forming a part hereof, in which like reference characters indicate corresponding parts in all the views:

FIG. 1 is a perspective view of the probe fitting of this invention;

FIG. 2 is a sectional view, on a larger scale of the probe fitting shown in FIG. 1 and with the probe fitting connected to a keg fitting and in combination with the annular valve structure of the keg fitting;

FIGS. 3 and 4 are circumferential sectional views taken at the radii 3—3 and 4—4, respectively, of FIG. 2; and FIG. 5 is a fragmentary, sectional view similar to FIG. 2 but showing the parts in position for drawing beer from a keg.

DESCRIPTION OF PREFERRED EMBODIMENT

FIG. 1 shows a probe fitting 10 which contains a probe 12 extending above the top of a hub 14 at the middle region of handles 16. There are threads 18, at the upper end of the probe 12, for connecting the probe with a hose through which beer is distributed to a manifold or faucet. Rotation of the handles 16 about the axis of the probe 12 moves the probe up and down, as will be explained more fully in connection with FIG. 2.

At the lower end of the probe fitting 10, there is a side wall which fits into a socket in a keg fitting; and on the side wall there is a part 20 which is an element of a bayonet connection by which the probe fitting is connected with the key fitting in a well-known manner. A sealing washer 22 at the lower end of the probe fitting cooperates with a shoulder in the keg fitting to form a seal between the probe fitting and the keg fitting, as will be more clearly shown in FIG. 2.

The probe fitting 10 has a branch connection 24 communicating with the interior of the probe fitting. A nipple 26 on the branch connection 24 is used for connection with a gas hose. The probe fitting 10 also has a safety valve 28 communicating with the interior of the fitting 10 for the escape of excess fluid pressure from within the fitting 10.

FIG. 2 is an enlarged sectional view of the structure shown in FIG. 1 and with the safety valve 28 moved 90° in order to be in the plane of section.

The threads 18 of the probe 12 are on an upper element 30 of the probe, and this upper element is of reduced diameter at its lower end and threads into a lower element 32 of the probe 12; and the lower element 32 extends downward and terminates in an annular end face 34 which is the surface of the probe 10 that displaces the valve in the keg in a manner which will be described.

The probe 12 is urged upward by a spring 36 compressed between a washer 38 and a shoulder 40 located at the bottom of the spring 36 and constituting a reduced diameter on the inside of a main body 42 of the probe fitting 12.

The washer 38 is located between faces 44 and 46 of the lower element 32 and upper element 30, respectively, of the probe 12.

Portions of the hub 14 of the handles 16 overlie the top surface of the washer 38 and push the washer and the probe 12 downward when the handles rotate the hub to operate cam mechanism that forces the hub 14 downward on the main body 42 when the hub is rotated by the handles 16.

A passage 52 extends lengthwise through the probe 12, and this passage 52 has an enlarged lower end 54 which terminates in the lower annular face 34 of the probe.

The probe fitting 10 is detachably connected with an inner part 56 of a keg fitting 58. An outer part 60 of the keg fitting 58 is permanently secured to a beer keg 62 by welding 64, or in any other suitable manner. An opening 66 through the keg 62 is located in line with the interior of the keg fitting. The inner part 56 has threads 68 which screw into complementary threads in the outer part 60; and a sealing ring 70 clamped between the bottom face of the inner part 56 and a shoulder on the outer part 60 seals the keg fitting against leakage along the threads 68.

The probe fitting 10 is secured to the keg fitting 58 by parts 20, of a bayonet type connection, which extends under lugs 72, constituting the other part of the bayonet connection. Such connections are commonly used for fastening probe fittings with keg fittings and no further description of the bayonet connection is necessary for a complete understanding of this invention.

A sealing ring or washer 22 seals the probe fitting 10 and keg fitting 58 by contact with a shoulder 74 within the keg fitting.

A resilient annular valve element 76 with a bottom stiffening washer 78 moves up and down along the outside surface of a down tube 80 which is in a fixed relation with the keg 62. The upper part of the down tube 80 is connected with a cup 84 by a snap ring 86; and the upper part of the cup 84 extends through the opening 66 in the top of the keg. The upper portion of the cup fits into the lower end of the inner part 56 of the keg fitting, as shown in FIG. 2. Thus the down tube 80 is held in a centered position with respect to the opening 66 and with respect to the probe fitting 10.

The outer circumference of the annular valve element 76 seats against a flange 88 extending inward from the inner part 56 of the keg fitting 58. The inner circumference of the annular valve element 76 seats against a flange 90 extending from a closed end 92 at the top of the down tube 80.

When the probe 12 is displaced downward, the lower annular face 74 of the probe displaces the resilient annular valve element 76 downward far enough for the inner circumference of the valve element 76 to uncover the upper ends of ports 94 so that beer within the down tube 80 can flow through these ports 94 and across the upper part of the inside circumference of the valve element 76 and into the enlarged end 54 of the passage 52. The contact of the lower annular face 74 with the resilient surface of the valve element 76 provides a seal which prevents beer from escaping across the top surface of the valve element 76. Thus the beer rises through the passage 52 and passes out through any hose or other conduit leading to the place where the beer is to be used.

The nipple 26 provides a source of gas when connected with a gas line leading to the probe fitting 10. The branch connection 24 contains a check valve, shown in FIG. 2 as a Thomas vent 96. This is a conventional check valve which is made of rubber or other soft resilient material which has lips 97 that open to permit gas to flow from the nipple 26 into the probe fitting 10; but which close to prevent any back flow of gas from the probe fitting to the nipple 26.

The safety valve 28 includes a valve element 98 which is held against a seat by a spring 100. A cap 102 screwed into the end of the safety valve 28 holds the spring 100 compressed against the back of the valve element 98 to hold the valve element closed. A stem 104 extends through the cap 102 and has a ring 106 by which the check valve can be pulled open manually in order to make periodic inspections to determine whether the valve element 98 may have become stuck to its seat.

There is a clearance 110 between the outside surface of the probe 12 and the inside surface of the probe fitting 10 at the region where the probe 12 is of maximum diameter. This clearance extends around the entire circumference of the probe 12, and when the probe is in raised position, as shown in FIG. 2, the clearance 110 is sealed by an O ring 112. When the probe 12 is moved downward so as to open the valve 76, a shoulder 114 on the probe 12 moves beyond the O ring 112, and the O ring does not expand enough to reach the circumference of the probe beyond the shoulder 114. This leaves the clearance 110 open for flow of gas from the branch connection 24 downward through the clearance 110 along the outside of the probe 12 which is in contact with the valve 76. With the valve 76 fully open, as shown in FIG. 5, the gas flows around the outside circumference of the valve 76 and into the cup 84 and through one or more openings 116 in the side of the cup to the interior of the keg 62 above the beer in the keg.

The lower part of the resilient annular valve element has its inside circumference of reduced diameter and its outside circumference of increased diameter, and these portions of the valve element 76 slide along cylindrical surfaces so that the valve element 76 does not actually open for either gas or beer until it has moved downward far enough to cover the lower portions of the ports 94. This is clearly illustrated by comparing FIG. 2 with FIG. 5.

There is a check valve 120 in the passage 52 for preventing back flow of beer toward the keg. This valve 120 is shown seated in FIG. 2. It is lifted by the beer moving upward through the passage 52, but there are angularly spaced projections 124 for preventing the check valve from seating against the lower end face of the upper element 30 of the probe 12.

There is an O ring 126 for preventing escape of beer along the threads that connect the upper element 30 of the probe with the lower element 32. There are also O rings 128 between the probe and the confronting wall of the probe fitting to prevent escape of gas from the interior of the probe fitting.

FIG. 3 is a diagrammatic view showing the way in which the part 20, which insert into the inner part 56 (FIGS. 1 and 5) of the keg fitting 58, can be moved downwardly so that its end portion 130 can move to a level lower than the lug 72 and then rotated so that the sloping top surface of the part 20 acts as a cam against the lug 72 to complete the bayonet connection between the probe fitting 10 and the inner part 56 of the keg fitting, shown in radial section in FIG. 2.

FIG. 4 shows the way in which studs or cam followers 134 extend from the interior surface of the hub 14 into a cam groove 136 formed in the outside surface of the upper part of the probe fitting. The groove which forms the cam 136 has an entrance 138 extending downward from the top face of the main body of the probe fitting, and the stud 134 on each side of the hub 14 is inserted through the entrance 138 and the hub 14 pushed down far enough, against the tension of the spring 36 (FIG. 2) to the lowest part of the entrance groove 138. The hub 14 is rotated by angular movement of the handles 16 to move each stud 134 into line with the cam groove 138. The hub 14 is rotated by angular movement of the handles 16 to move each stud 134 into line with the cam groove 136. This maneuver is made only at the time of assembling the hub 14 and handle 16 with the probe fitting; and the handles 16 and hub 14 are moved back and forth along the length of the cam 136, being held against the upper surface of the cam slot by pressure of the spring which urges the probe upward. When the handles 16 (FIG. 2) have been turned far enough to fully depress the probe, the stud 134 reaches the end of the cam 136, as shown in dotted lines in FIG. 4, and there is a recess in the top surface into which the stud 134 can move to hold the probe in its fully depressed position against the pressure of the spring 36 (FIG. 2). In order to again raise the probe, some downward pressure is put on the handles 16, hub 14 and studs 134, while exerting a turning movement to bring the studs 134 into contact with the upwardly sloping cam 136.

The hub 14 moves the probe in the opposite direction when the studs 134 move along the cam surface 136 so that the rising movement of the probe 12 brings the shoulder 114 into contact and beyond the seating ring 112 so the gas flow through the probe fitting is shut off.

The apparatus is constructed so that the handles 16 (FIG. 2) have angular movement in the same direction for making the bayonet connection 20 and for operating the cams that push the probe downward. When the probe fitting is first inserted into the bayonet connection, rotation of the handles 16 tightens the bayonet connection and secures the probe fitting to the keg. This operation tends to move the probe downward by moving the cam mechanism between the hub 14 and the main body of the probe fitting, but this movement is opposed by the pressure of the spring 36, so that the bayonet connection tightens up and secures the probe fitting to the keg before the probe has been pushed down far enough to open the valve 76. Further movement of the handles 16 in the same direction eventually opens the valve 76 so that anyone connecting the probe fitting to a keg, and turning the handles 16 to their limit of travel, will first connect the probe fitting to the keg and then open the keg valve so that the connection to the keg is made and the keg valve opened by the same operation. This eliminates the possibility of connecting a beer hose with a keg and forgetting to open the keg valve.

The preferred embodiment of the invention has been illustrated and described, but changes and modifications can be made and some features can be used in different combinations without departing from the invention as described in the claims.

What is claimed is:

1. Beer distributing apparatus including in combination a probe fitting that fits into an opening in a keg fitting secured to a beer keg or the like, projections extending outward from the probe fitting for engaging cam slots inside the keg fitting for connecting the probe fitting with the outlet through the keg fitting, a probe located within the probe fitting and having up and down movement with respect to both fittings, the probe having a passage for beer opening through the lower end of the probe and extending upward to a hose connection at an upper part of the probe, a gas passage on one side of the probe fitting and opening into the interior of the probe fitting, clearance between confronting cylindrical faces on the inside of a lower portion of the probe fitting and the outside of the probe for flow of gas along said clearance between said cylindrical faces, a seal carried by one of said confronting cylindrical faces and contacting with the other confronting cylindrical face to shut off flow of gas through said clearance when the probe is in a raised position, and a shoulder providing a step on the cylindrical face that confronts the face that carries the seal, said shoulder being in position that is beyond the seal and that leaves said gas passage and said channel unsealed when the probe is in a lowered position, biasing means on the probe fitting for biasing the probe to a shutting raised position off the gas flow when not connected with a keg, and means for moving the probe downward against the bias of the biasing means into said lowered position for operating a keg valve when the probe fitting is connected with a keg.

2. The beer dispensing apparatus described in claim 1 characterized by a keg fitting, and an annular valve in an opening through the keg fitting, the probe having an annular face at its lower end for displacing the annular valve by contact with an intermediate annular area between the outer and inner circumferences of said annular valve for connecting the space within the annular probe with a supply of beer from a down tube and for connecting the space outside of the annular probe with a supply of gas to the keg.

3. The beer dispensing apparatus described in claim 2 characterized by a keg having a beer outlet with which the keg fitting is connected, the beer outlet having a down tube with which the probe fitting can be put into and out of communication, means for holding the down tube against transverse movement including a cylindrical housing connected with and extending around an upper end of the down tube, an inwardly extending bottom of the cylindrical housing enclosing a space below the valve for the full diameter of the valve, a top connected to and closing the upper end of the down tube, a flange extending beyond the outer periphery of the down tube at the upper end thereof, a complementary flange on the inside of the keg fitting and extending toward the flange of the down tube but spaced radially from the flange of the down tube so as to leave an annular passage between the flanges, said flanges forming valve seats at both sides of the annular passage, the annular valve element spanning said annular passage and that has radially inner and outer edge portions seated on said valve seats, resilient means holding the valve closed against the seats, the valve having a cylindrical face at its lower end contacting with a confronting surface of the probe around the entire circumference of the confronting face of the probe when the valve is partly open.

4. The beer dispensing apparatus described in claim 3 characterized by the annular valve element having its cylindrical inside surface that slides on a complementary confronting cylindrical surface on the outside of the down tube as a guide to hold the valve in alignment with the probe, and a spring compressed between the bottom of the cylindrical housing and the lower surface of the annular valve element for urging the valve element into closed position against said valve seats.

5. The beer dispensing apparatus described in claim 3 characterized by the down tube having ports opening through its circumference below its closed upper end and at locations that are initially shut off from communication with space above the annular valve by said annular valve, the stroke of the valve being sufficiently long to leave part of the areas of the ports uncovered above the valve when the valve is depressed so that beer can flow through said ports and across the top of the valve to the inside surface of the probe and then upward through the probe to the hose connection at the top of the probe.

6. The beer dispensing apparatus described in claim 3 characterized by a cylindrical surface immediately beyond the valve seats and in contact with inner and outer circumferential surfaces of the valve as it moves downward along the down tube, the valve element being stiff enough to remain in contact with the annular lower end of the probe around the full circumference of the probe whenever the valve is in contact with the probe so as to prevent leakage of beer radially outward between the bottom of the probe and the top surface of the valve.

7. The beer dispensing apparatus described in claim 6 characterized by the valve having a stiff plate across its bottom surface for imparting stiffness to the resilient upper portion of the valve.

8. The beer dispensing apparatus described in claim 3 characterized by the upper fitting and the down tube having cylindrical surfaces in contact with outer and inner cylindrical surfaces, respectively, of the valve below the valve seats.

9. The beer dispensing apparatus described in claim 3 characterized by the upper down tube fitting, the down tube, and the cylindrical housing at the upper end of the down tube being secured in fixed relation to the keg.

10. The beer dispensing apparatus described in claim 1 characterized by the probe having a lower portion that moves downward with the rest of the probe when the probe is connected with the keg fitting, a valve seat in an enlarged portion of the passage through the probe, a check valve that contacts with the valve seat to prévent backflow of beer toward the keg, and an upper element of the probe that threads into an upper end of a lower element and that has a passage therein of smaller cross-section than said enlarged portion, the upper part of the probe terminating above the check valve and having side wall openings for flow of beer into the upper part of the probe when the valve is open.

11. Beer distributing apparatus including in combination a probe fitting that connects with an outlet connection on a keg, a probe located within the probe fitting, the probe having a passage for beer opening the lower end of the probe and extending upward to a hose connection at an upper part of the probe, a gas connection on one side of the probe fitting and opening into the interior of the probe fitting, clearance between the inside of a lower portion of the probe fitting and the outside of the probe for flow of gas along the outside of the probe, means within the fitting for shutting off flow of gas through said clearance when the probe is in raised position, means on the probe fitting for holding the probe in raised position when not connected with the keg, and means for moving the probe downward into said lowered position for operating a keg valve when the fitting is connected with the keg, characterized by means at a lower part of the probe fitting for connecting the probe fitting with a keg including elements of a bayonet connection projecting from sides of the probe fitting for downward insertion and then rotary movement about a substantially vertical axis to secure the connection, and a cam mechanism at another part of the probe fitting that is rotated about a substantially vertical axis to move the probe downward in its fitting, a handle connected with the cam mechanism, a spring resisting downward movement of the probe, the rotary movement to complete operation of the bayonet connection being in the same direction as the rotary movement that operates the cam mechanism to move the probe downward, whereby initial rotation of the handle connects the fitting with the keg by the bayonet connection and tensions the spring that resists downward movement of the probe, and further rotation of the handle, after connecting the fitting to the keg, overcomes the force of the probe spring and moves the probe downward for opening a valve in the keg with both operations performed sequentially by a single rotary stroke of the handle in one direction.

12. Beer distributing apparatus including in combination a probe fitting for connecting with an outlet connection of a keg, means at a lower part of the probe fitting for connecting the probe fitting with a keg including elements of a bayonet connection projecting from sides of the probe fitting for downward insertion and then rotary movement about a substantially vertical axis to secure the connection, and a cam mechanism at another part of the probe fitting that is rotated about a substantially vertical axis to move the probe downward, a handle connected with the cam mechanism, a spring resisting downward movement of the probe, the rotary movement to complete operation of the bayonet connection being in the same direction as the rotary movement that operates the cam mechanism to move the probe downward, whereby initial rotation of the handle connects the fitting with the keg by the bayonet connection, and tensions the springs that resists downward movement of the probe, and further rotation of the handle, after connecting the fitting to the keg, overcomes the force of the probe spring and moves the probe downward for opening a valve in the keg with both operations performed sequentially by a single rotary stroke of the handle in one direction.

* * * * *

UNITED STATES PATENT OFFICE

CERTIFICATE OF CORRECTION

PATENT NO. : 4,180,189

DATED : December 25, 1979

INVENTOR(S) : David Zurit, Vincent Cerrato, James Hines

It is certified that error appears in the above-identified patent and that said Letters Patent are hereby corrected as shown below:

In Claim 1, line 60, the word shutting should be moved from its present position and inserted after the words "raised position."

Signed and Sealed this

*First* Day of *April 1980*

[SEAL]

*Attest:*

SIDNEY A. DIAMOND

*Attesting Officer*

*Commissioner of Patents and Trademarks*